US008118401B2

(12) United States Patent
Yoshida

(10) Patent No.: US 8,118,401 B2
(45) Date of Patent: Feb. 21, 2012

(54) PRINTING APPARATUS

(75) Inventor: Seishin Yoshida, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 349 days.

(21) Appl. No.: 12/549,322

(22) Filed: Aug. 27, 2009

(65) Prior Publication Data

US 2010/0053267 A1 Mar. 4, 2010

(30) Foreign Application Priority Data

Aug. 28, 2008 (JP) ..... 2008-219055

(51) Int. Cl.
*B41J 2/205* (2006.01)

(52) U.S. Cl. ..... 347/43

(58) Field of Classification Search ..... 347/12, 347/15, 40, 41, 43, 98
See application file for complete search history.

(56) References Cited

U.S. PATENT DOCUMENTS 6,869,174 B2 * 3/2005 Faken ..... 347/101
7,553,011 B2 * 6/2009 Odell et al. ..... 347/103

FOREIGN PATENT DOCUMENTS

JP 2002-530229 A 9/2002
WO WO 00/30856 A1 6/2000

* cited by examiner

*Primary Examiner* — Lamson Nguyen
(74) *Attorney, Agent, or Firm* — Kilpatrick Townsend & Stockton LLP

(57) ABSTRACT

Provided is a printing apparatus that superposedly forms an image layer representing an image and a specific glossy layer that is different from the image layer on a printing medium, including: a first connection unit, a second connection unit, a reception unit, a print head and at least one of specific color nozzle columns and a printing unit, wherein at least the connection unit that can supply the ink to the end-portion specific color nozzle column inside the second connection unit can be connected to a specific gloss agent container containing a specific gloss agent that is used to form the specific glossy layer instead of the specific color ink container, and wherein, when the specific gloss agent container is connected to the second connection unit and the reception unit receives the specific gloss agent as the available ink, the printing unit ejects the specific gloss agent from the end-portion specific color nozzle column to form the specific glossy layer.

7 Claims, 10 Drawing Sheets

PRINTING APPARATUS

This application claims priority to Japanese Patent Application No. 2008-219055, filed Aug. 28, 2008, the entirety of which is incorporated by reference herein.

BACKGROUND

1. Technical Field

The present invention relates to a printing technology for superposedly forming an image layer representing an image and a specific glossy layer that is different from the image layer on a printing medium.

2. Related Art

A method in which a primer coating layer is firstly formed on a printing medium and printing is performed on the primer coating layer is known (for example, Patent Document JP-T-2002-530229). The method can be adapted to various printing methods. For example, the method can be used to reproduce metallic colors having various tones. In order to reproduce the metallic color, for example, a metallic ink layer may be formed on a printing medium, and color inks are superposedly printed on the metallic ink layer.

However, in order to perform the metallic color printing in the an ink jet printer, a print head needs to have separate nozzles that eject metallic inks as well as nozzles that eject color inks for forming an image. Therefore, there is a problem in that cost for the printing apparatus is increased. Particularly, the printing apparatus is relatively expensive for a user who does not frequently use the metallic color printing. The problem is not limited to the metallic color printing, but it commonly occurs in cases where an image layer representing an image and another layer are superposedly printed on the printing medium.

SUMMARY

An advantage of some aspects of the invention is to suppress an increase in cost of a printing apparatus and to efficiently print a plurality of ink layers.

The invention is to provide at least a portion of the aforementioned problems. Therefore, the invention can be implemented by the following embodiments or application examples.

According to an aspect of the invention, there is provided a printing apparatus that superposedly forms an image layer representing an image and a specific glossy layer that is different from the image layer on a printing medium, including: a first connection unit that can be connected to a basic color ink container containing three primary color inks of which combination is used for performing color representation; a second connection unit that can be connected to a specific color ink container containing a specific color ink other than the three primary color inks; a reception unit that receives a kind of print available ink; a print head where nozzle columns in which a plurality of nozzles are aligned in a predetermined direction are arrayed in a direction intersecting an alignment direction of the nozzles in the nozzle columns, and at least one of specific color nozzle columns ejecting the specific color ink among the nozzle columns is disposed as an end-portion specific color nozzle column to at least one of end portions of the print head in the array direction of the nozzle columns; and a printing unit that performs printing by moving the print head relative to the printing medium and ejecting the three primary color inks and/or the specific color ink on the printing medium from the nozzle columns. At least the connection unit that can supply the ink to the end-portion specific color nozzle column inside the second connection unit can be connected to a specific gloss agent container containing a specific gloss agent that is used to form the specific glossy layer instead of the specific color ink container. When the specific gloss agent container is connected to the second connection unit and the reception unit receives the specific gloss agent as the available ink, the printing unit ejects the specific gloss agent from the end-portion specific color nozzle column to form the specific glossy layer.

In the printing apparatus having the configuration, a specific gloss agent instead of the specific color ink can be ejected from the end-portion specific color nozzle column disposed to at least one end portion in the alignment direction of the nozzle columns. Since the end-portion specific color nozzle column is disposed at the end portion in the alignment direction, the specific gloss agent can be ejected before any one of the three primary color inks and the specific color ink or after any one thereof according to the direction of the relative movement of the print head with respect to the printing medium. In other words, the specific glossy layer and the image layer can be superposedly printed on the printing medium in the order of the specific glossy layer and the image layer or in the order of the image layer and the specific glossy layer. In addition, since specific gloss agent is ejected by using the specific color nozzle column, the print head needs not to have any nozzle column dedicated to the specific gloss agent, so that it is possible to implement an economical printing apparatus.

In the printing apparatus according to the invention, the end-portion specific color nozzle columns may be disposed at both end portions of the print head in the array direction of the nozzle columns, and printing unit may eject the specific gloss agent from one of the end-portion specific color nozzle columns disposed at both end portions according to the direction of the relative movement of the print head to form the specific glossy layer.

In the printing apparatus having the configuration, since the specific gloss agent is ejected from any one of the end-portion specific color nozzle columns disposed at the two end portions in the alignment direction of the nozzle columns of the print head, the ejecting order of the specific gloss agent, the three primary color inks, and the specific color inks can be changed. In other words, the specific glossy layer and the image layer can be superposedly printed in a desired order. In addition, in a case where the printing apparatus is a serial type printing apparatus, even in bi-directional printing where the ink or the like is ejected from any one of the directions of the relative movements, the image layer and the specific glossy layer can be superposedly printed in a desired order by changing the end-portion specific color nozzle columns ejecting the specific gloss agent according to the directions of the relative movement of the print head.

In the printing apparatus according to the invention, each of the basic color ink container, the specific color ink container, and the specific gloss agent container may include a storage unit storing the kind of the contained ink and a communication unit communicating with the printing apparatus, and the reception unit may perform the reception by receiving a signal indicating the kind of ink through the communication unit from the container that is connected to the first connection unit or the second connection unit.

Since the printing apparatus having the configuration receives signals from the connected container to receive the kinds of the available inks, that is, to receive the kinds of the inks contained in the connected container, the printing apparatus can be easily manipulated.

In the printing apparatus according to the invention, the end-portion specific color nozzle column may be a nozzle column that ejects the specific color ink other than a black ink.

Since the specific color inks except for the black ink generally has a low use frequency in comparison with the black ink, in the printing apparatus having the configuration, influence of connection of the specific gloss agent container to at least a portion of the second connection unit to the image quality of the image layer can be suppressed in a low level.

In the printing apparatus according to the invention, the end-portion specific color nozzle column may be a nozzle column that ejects a light ink where coloring ingredients of the three primary color inks have low concentrations.

Since the printing apparatus having the configuration can be adapted to a printing apparatus using light inks, the printing apparatus can be used with high general versatility.

The aforementioned printing apparatuses can be applied to specific gloss agents of Application Example 6 or 7.

In the printing apparatus according to the invention, the specific gloss agent may be an ink of which optical property has a reflection angle dependency when the ink is printed on a surface of the printing medium.

In the printing apparatus according to the invention, the specific gloss agent may be an ink that includes a pigment expressing a metallic sensation.

BRIEF DESCRIPTION OF THE DRAWINGS

The following description will be clarified by the specification and the accompanying drawings.

DESCRIPTION OF EXEMPLARY EMBODIMENTS

A. Printing System

Figure 1:
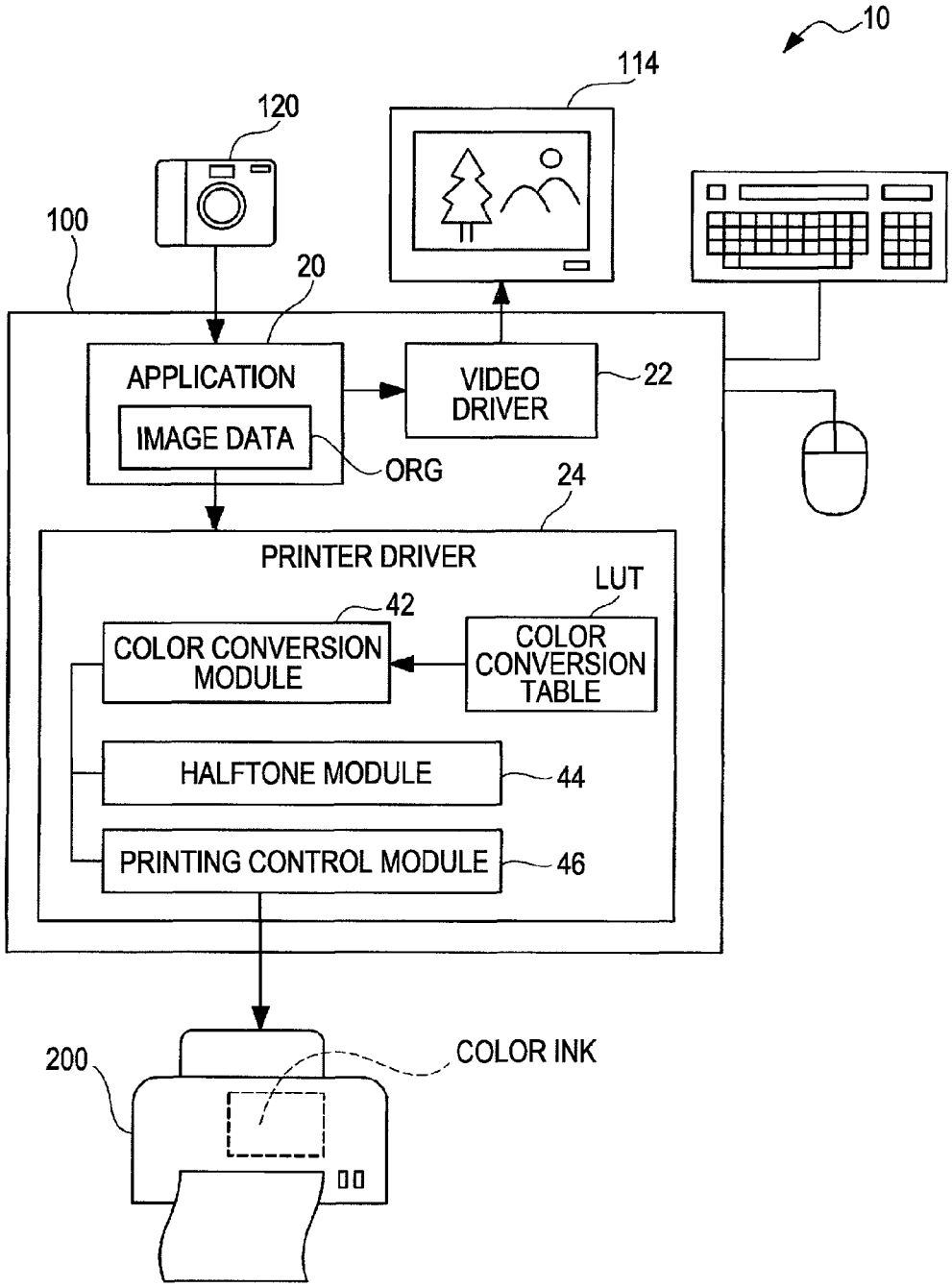
FIG. 1 is a schematic view showing a configuration of a printing system 10 according to an embodiment of the invention.

FIG. 1 is a schematic view showing a configuration of a printing system 10 according to an embodiment of the invention. As shown in the figure, the printing system 10 according to the embodiment includes a computer 100 that is used as a printing control apparatus and a printer 200 that actually prints an image under the control of the computer 100. The printing system 10 integrally functions as a printing apparatus in a wide sense.

In the printer 200 according to the embodiment, a cyan ink C, a magenta ink M, a yellow ink Y, a black ink K, a light cyan ink Lc, and a light magenta ink Lm are provided as color inks. In addition, instead of the inks, a metallic ink S may be provided. In addition, in the invention, "color ink" may also include a black ink. In the embodiment, the color ink is a dye ink. However, the kind of the color inks is not particularly limited. Therefore, for example, the color ink may be a pigment ink. In addition, in the embodiment, among the color inks, the cyan ink C, the magenta ink M, and the yellow ink Y that are used for color representation using subtractive color mixture are referred to as "three primary color inks", and except for the three primary color inks, the black ink K, the light cyan ink Lc, and the light magenta ink Lm are referred to as "specific color inks".

The metallic ink is an ink that allows a printed material to express a metallic sensation. For example, as the metallic ink, an oil ink composition of a metallic pigment expressing the metallic sensation, an inorganic solvent, and a resin may be used. In order to effectively form visually-metallic sensation, the aforementioned metallic pigment is preferably constructed with tabular particles. In a case where a planar long diameter, a planar short diameter, and a thickness of the tabular particle are X, Y, and Z, respectively, it is preferable that an average particle diameter R50 which is 50% of a circle-equivalent diameter obtained from an area of an X-Y plane of a tabular particle is in a range of 0.5 to 3 μm, and a condition of R50/Z>50 is satisfied. For example, the metallic pigment may be formed from aluminum or an aluminum alloy. In addition, the metallic pigment may be prepared by crushing a metal vaporizing layer. A concentration of the metallic pigment included in the metallic ink may be, for example, in a range of 0.1 to 10.0 wt %. The composition of the metallic ink is not limited thereto. Other compositions that can create a metallic sensation may be suitably employed.

In the embodiment, the composition of the metallic ink S is 1.5 wt % of aluminum pigment, 20 wt % of glycerin, 40 wt % of triethylene glycol monobuthyl ether, and 0.1 wt % of BYK-UV3500 (manufactured by BYK Chemie Japan).

A predetermined operating system is installed in the computer 100, and an application program 20 is operated under the operating system. In the operating system, a video driver 22 or a printer driver 24 is assembled. For example, the application program 20 inputs image data ORG from a digital camera 120 through a peripheral-apparatus interface 108. Next, the application program 20 displays an image represented by the image data ORG on a display 114 by using the video driver 22. In addition, the application program 20 outputs the image data ORG to the printer 200 by using the printer driver 24. The image data ORG that the application program 20 inputs from the digital camera 120 are data constructed with three color components, that is, red (R), green (G), and blue (B).

The application program 20 can designate, with respect to an arbitrary area within the image data ORG, an area (hereinafter, referred to as a "metallic area") constructed with a metallic color as well as an area (hereinafter, referred to as a "color area") constructed with R, G, and B color components. The metallic area and the color area may be superposedly disposed. In other words, these areas may be designated so that a color image is formed on a background of which color is a metallic color.

The printer driver 24 includes a color conversion module 42, a halftone module 44, and a printing control module 46.

The color conversion module 42 converts the color components R, G, and B of the color area in the image data ORG to color components (cyan (C), magenta (M), yellow (Y), black (K), light cyan (Lc), and light magenta (Lm) colors) that can be represented by the printer 200 according to a prepared color conversion table LUT.

The halftone module 44 performs a halftone process that can represent gradation of the image data color-converted by the color conversion module 42 by using a distribution of dots. In the embodiment, a well-known ordered dither method is used as the halftone process. In addition to the ordered dither method, an error diffusion method, a concentration pattern method, or other halftone techniques may be used as the halftone process.

The printing control module 46 performs controlling the printer 200 by aligning data sequence of the halftone-processed image data in the order for transmission to the printer 200, outputting the data sequence as printing data to the printer 200, and outputting various commands such as a printing start command and a printing end command to the printer 200. In addition, the printing control module 46 forms dots with the metallic ink on the metallic area designated by the application program 20.

B. Configuration of Apparatus

Figure 2:
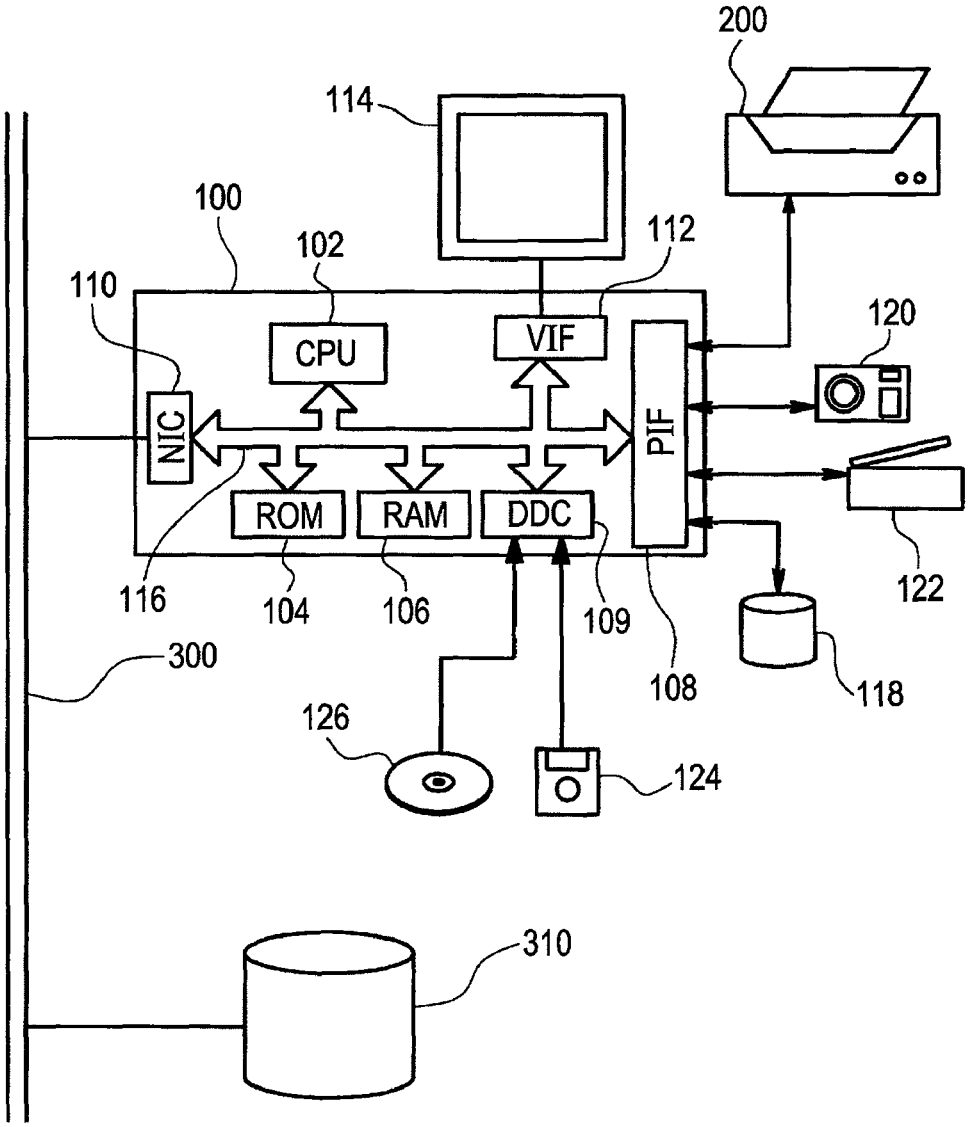
FIG. 2 is a view showing a configuration of a computer 100 as a printing control apparatus.

FIG. 2 is a view showing a configuration of the computer 100 as the printing control apparatus. The computer 100 is a well-known computer where a CPU 102, a ROM 104, a RAM 106, and the like are connected to each other through a bus 1 16.

A disk controller 109 that is used to read data from a flexible disk 124, a compact disk 126, or the like, a peripheral-apparatus interface 108 that is used to receive/transmit data from/to peripheral apparatuses, and a video interface 112 that is used to drive the display 114 are connected to the computer 100. The printer 200 and the hard disk 118 are connected to the peripheral-apparatus interface 108. In addition, if a digital camera 120 or a color scanner 122 is connected to the peripheral-apparatus interface 108, an imaging process can be performed on an image acquired by the digital camera 120 or the color scanner 122. In addition, if a network interface card 110 is installed, the computer 100 is connected thereto through a communication line 300, and thus, data stored in a storage unit 310 connected to the communication line can be acquired. If the computer 100 acquires to-be-printed image data, the computer 100 performs printing of the image data by controlling the printer 200 through the function of the aforementioned printer driver 24.

Figure 3:
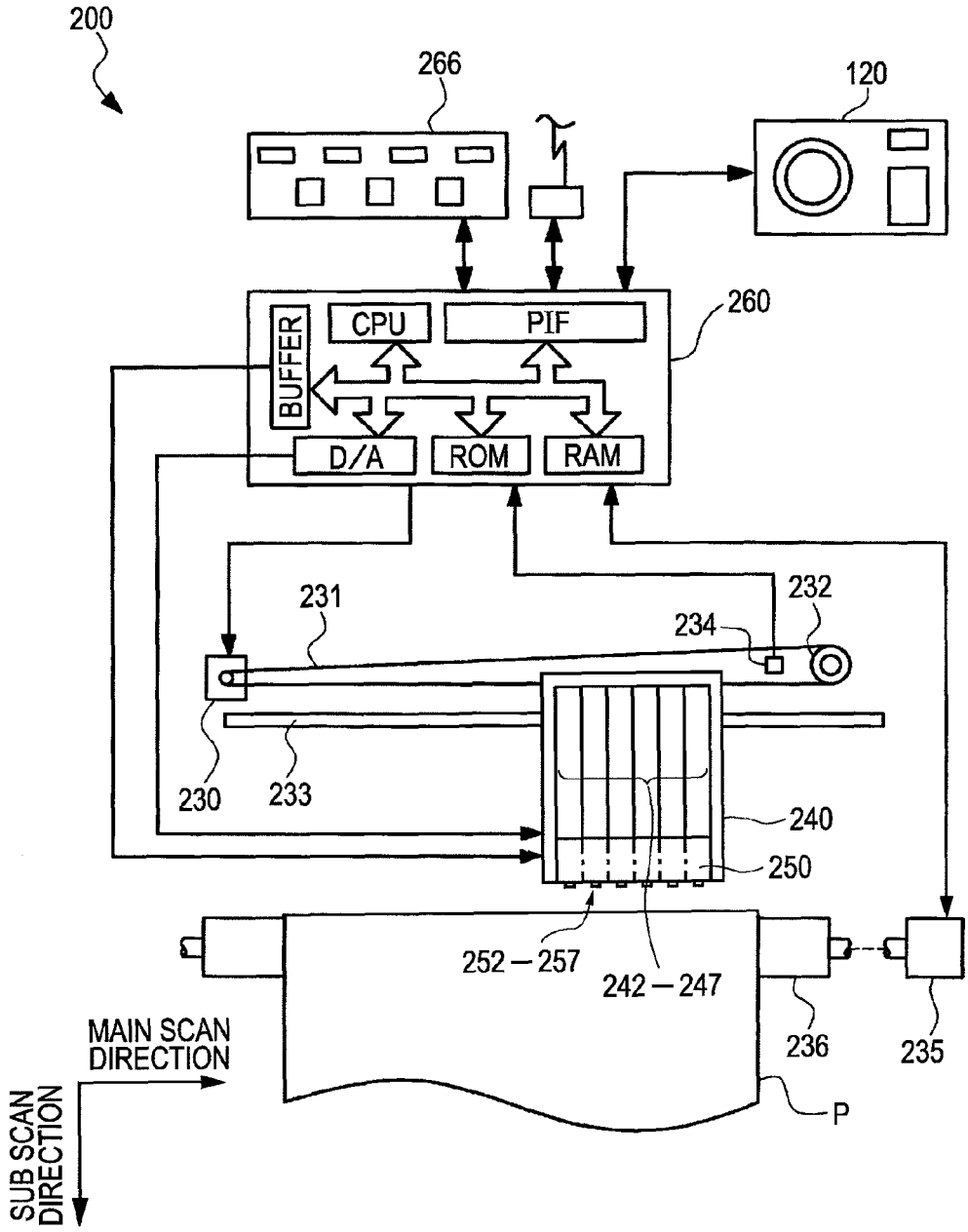
FIG. 3 is a view showing a configuration of a printer 200.

Next, a configuration of the printer 200 is described with reference to FIG. 3. As shown in FIG. 3 the printer 200 includes a mechanism for transporting a printing medium P by using a sheet transporting motor 235, a mechanism for reciprocatingly moving a carriage 240 in a shaft direction of a platen 236 by using a carriage motor 230, a mechanism for ejecting ink and forming dots by driving a print head 250 mounted in the carriage 240, and a control circuit 260 that controls signal communication with the sheet transporting motor 235, the carriage motor 230, the print head 250, and a manipulation panel 266.

The mechanism for reciprocatingly moving the carriage 240 in the shaft direction of the platen 236 includes a sliding shaft 233 that is disposed in parallel to the shaft of the platen 236 to slidably support the carriage 240, a pulley 232 that longitudinally provides an endless driving belt 231 in a space between the pulley 232 and the carriage motor 230, and a position detecting senor 234 that detects an original position of the carriage 240.

Color ink cartridges 242 to 247 that contain color inks, that is, a cyan ink C, a magenta ink M, a yellow ink Y, a black ink K, a light cyan ink Lc, and a light magenta ink Lm, respectively, are mounted in the carriage 240. Six kinds of nozzle columns 252 to 257 corresponding to the aforementioned color inks are formed in the print head 250 in a lower portion of the carriage 240. When the ink cartridges 242 to 247 are mounted in the carriage 240 from the upper side, the inks can be supplied from the cartridges to the nozzle columns 252 to 257. In addition, in the embodiment, the ink cartridges 242 to 247 have IC chips in which kinds of contained inks are recorded. Therefore, although not shown, if the ink cartridges 242 to 247 are mounted in the carriage 240, the IC chips are designed to be electrically connected to the control circuit 260. The aforementioned nozzle columns 252 to 257 correspond to the specific color nozzle columns in Claims. The aforementioned nozzle columns 256 and 257 correspond to the end-portion specific color nozzle column in Claims. In addition, the carriage 240 corresponds to the first connection unit and the second connection unit in claims. Although the first and second connection units in claims may be separately constructed, the first and second connection units may be integrally constructed like the connection unit of the embodiment.

In the control circuit 260 of the printer 200, a CPU, a ROM, a RAM, a PIF (peripheral-apparatus interface), and the like are connected through a bus. The control circuit 260 controls main and sub scan movements of the carriage 240 by controlling operations of the carriage motor 230 and the sheet transporting motor 235. In addition, if the control circuit 260 receives the printing data output from the computer 100 through the PIF, the control circuit 260 can drive the print head 250 for each color by applying a driving signal corresponding to the printing data to the print head 250 in accordance with the main or sub scan movement of the carriage 240. In addition, the control circuit 260 corresponds to a printing unit in Claims and also has a function as a reception unit.

In the printer 200 having the aforementioned configuration, the print head 250 (nozzle columns 252 to 257 corresponding to the colors) is reciprocatingly moved in a main scan direction with respect to the printing medium P by driving the carriage motor 230, and the printing medium P is moved in a sub scan direction by driving the sheet transporting motor 235. The control circuit 260 forms ink dots having suitable colors at suitable position on the printing medium P by driving nozzles at suitable timings based on the printing data in accordance with the reciprocating movement (main scan) of the carriage 240 or the sheet transporting movement (sub scan) of the printing medium P. As a result, the printer 200 can print a color image on the printing medium P. In addition, in the aforementioned configuration, the ink for each color is contained in a detachable cartridge that is mounted in the printer 200. Alternatively, the ink may be contained in an ink containing tank that is constructed in separation from the printer 200, and the ink containing tank and the printer 200 can be connected. In addition, alternatively, the three primary color inks may be contained in a non-detachable container that is integrally provided to the printer 200.

In addition, in the printer 200 according to the embodiment, the ink is ejected only in the forward movement path among the reciprocating movement of the print head 250 in the main scan direction, and one-directional printing that can implement high quality printing is used as default setting. In addition, in the printer 200, a transparent printing medium such as an OHP film as well as an opaque printing medium such as normal paper and coat paper can be used as the printing medium P.

C. Details of Printing Head

Figure 4:
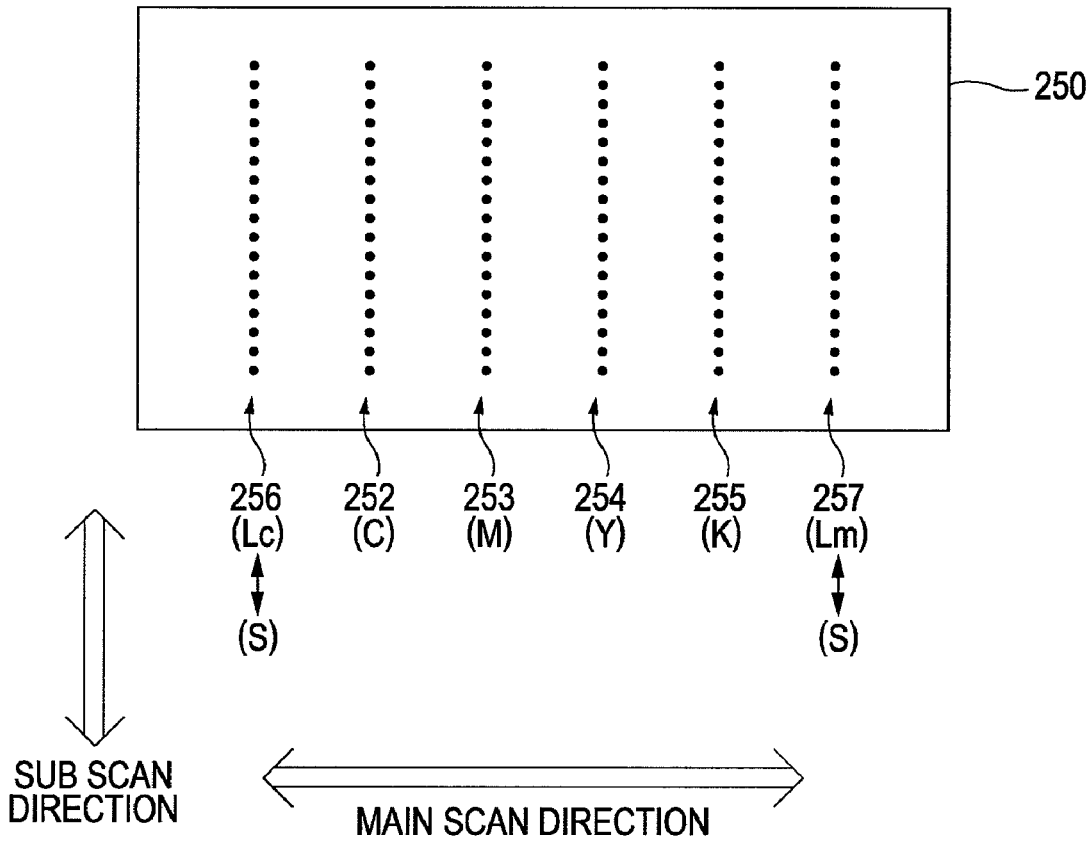
FIG. 4 is a view for explaining details of a print head 250.

FIG. 4 shows details of the aforementioned print head 250. In the figure, a lower surface of the print head 250 (that is, a surface facing the printing medium P) is schematically shown. As shown in the figure, the print head 250 includes a plurality of the nozzle columns 252 to 257 that are aligned in the sub scan direction. In the embodiment, each nozzle column is constructed with 180 nozzles. The nozzle columns 252 to 257 correspond to ink colors of the cartridges mounted in the carriage 240, so that the nozzle column 252 to 257 can eject the cyan ink C, the magenta ink M, the yellow ink Y, the black ink K, the light cyan ink Lc, and the light magenta ink Lm, respectively. In addition, in the embodiment, in each nozzle column corresponding to each ink color, the nozzles are aligned in one column, but the alignment of nozzles in one nozzle column is not particularly limited. For example, the nozzles may be aligned in multiple columns. Alternatively, the nozzles in the multiple columns may be disposed in a zigzag manner.

In addition, as shown in the figure, in the print head 250, among the nozzle columns 252 to 257 that eject specific color inks, the nozzle column 256 corresponding to the light cyan ink Lc is disposed at the one end portion in the alignment direction of the nozzle columns 252 to 257. In addition, the nozzle column 257 corresponding to the light magenta ink Lm is disposed at the other end portion in the alignment direction of the nozzle columns 252 to 257. If the ink cartridges 246 and 247 containing the light cyan ink Lc and the light magenta ink Lm which are mounted in the carriage 240 are detached from the carriage 240 and if the ink cartridges 246 and 247 are replaced with the ink cartridge containing the metallic ink S, the nozzle columns 256 and 257 can eject the metallic ink S. Hereinafter, the replacement of the ink cartridges is referred to as "ink change".

D. Printing Process

Figure 5:
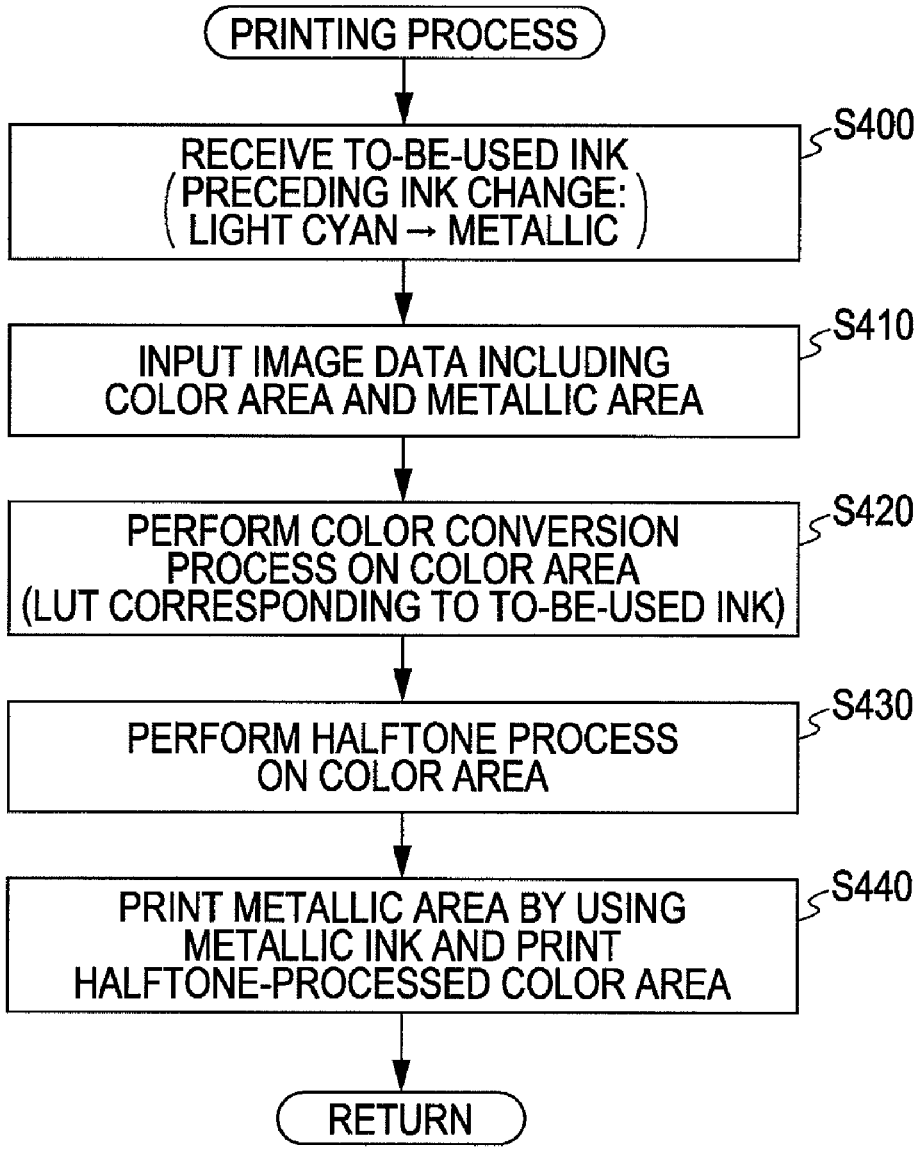
FIG. 5 is a flowchart showing a procedure of a printing process.

Now, the metallic color printing process that the computer 100 performs by using the functions of the printer driver 24 is described. FIG. 5 is a flowchart showing the printing process according to the embodiment. In the embodiment, after a user performs the ink change from the light cyan ink Lc to the metallic ink S, the user instructs printing execution by manipulating the computer 100, so that the printing process starts. When the printing process starts, the computer 100 firstly receives kinds of available inks (Step S400). More specifically, the computer 100 periodically transmits signals to the IC chips provided to the ink cartridges 242 to 247. In response to the received signal, the IC chips transmit signals indicating the kinds of inks recorded in the storage area to the computer 100. The computer 100 analyzes the response signals to receive the kind of the ink cartridges 242 to 247 mounted in the carriage 240, that is, the kinds of the available inks. In the embodiment, the metallic ink S, the cyan ink C, the magenta ink M, the yellow ink Y, the black ink K, and the light magenta ink Lm are received as the available inks. In addition, the method for receiving the available inks is not limited to the aforementioned method. For example, in a configuration, the kinds of the ink cartridges mounted in the carriage 240 may be input by user's manipulating the computer 100, and the computer 100 may receive the kinds of the ink cartridges.

If the computer 100 receives the available inks, the computer 100 inputs image data designating the metallic area and the color area from the application program 20 by the printer driver 24 (Step S410).

If the image data is input, the computer 100 converts RGB-format image data to CMYKLcLm-format image data in the color area of the image data (Step S420). The conversion is performed by using a color conversion table LUT corresponding to the kinds of the available inks received in the Step S400 among a plurality of stored color conversion tables LUT. When the CMYKLcLm-format image data is obtained, the computer 100 performs a halftone process by using the halftone module 44 to generate data that can be transmitted to the printer 200 (Step S430).

After the halftone process, the computer 100 controls the printer 200 to print the metallic area by using the metallic ink S and to print the halftone-processed color area by using the color ink (Step S440). In addition, the printing medium P1 used in the embodiment is an opaque printing medium. In addition, in the embodiment, the computer 100 performs the one-directional printing by ejecting inks only in the forward movement path among the reciprocating movement of the print head 250 in the main scan direction.

Figure 6A:
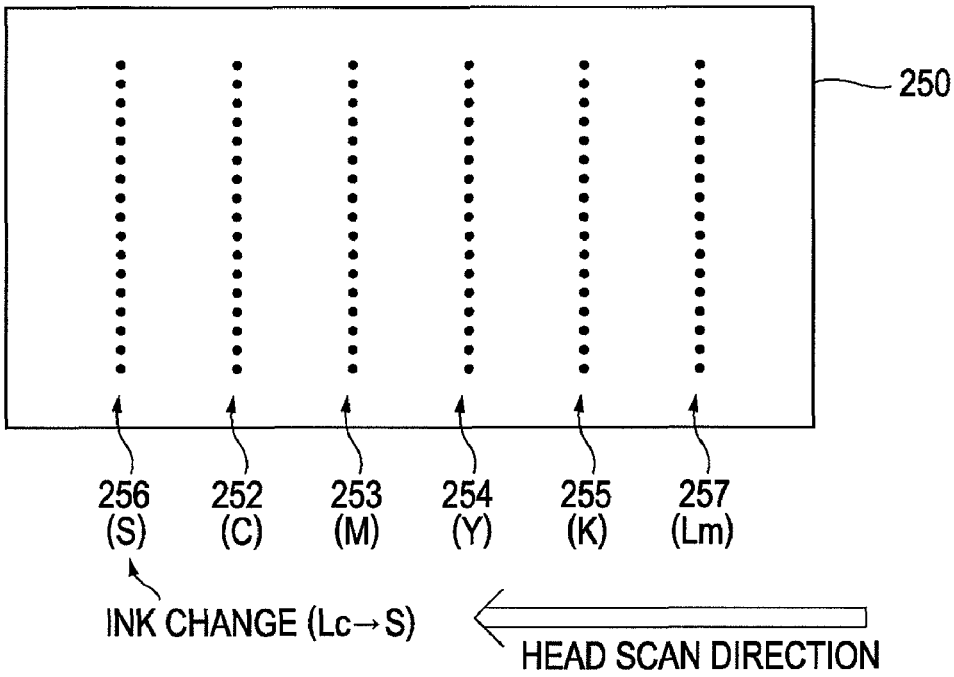
FIGS. 6A and 6B are views for explaining situation of ink change and printing in a printing process.

The aforementioned Step S440 is described in detail with reference to FIGS. 6A and 6B. The scan direction of the print head 250 shown in FIG. 6A is the direction of the forward movement among the reciprocating movement in the main scan direction, that is, the scan direction in which the ink ejecting is performed. As shown in the figure, in the print head 250 according to the embodiment, since the ink change from the preceding light cyan ink Lc to the metallic ink S is performed, the nozzle column 256 disposed at the front end portion in the scan direction in which the ink ejecting is performed ejects the metallic ink S. Herein, the nozzle column 256 ejecting the metallic ink S firstly reaches a predetermined printing position on the printing medium P1 prior to the other nozzle columns, so that the metallic ink S prior to the color inks is ejected. Next, according to the movement of the print head 250, the nozzle columns 252 to 255 and 257 reach predetermined positions, so that color inks are ejected.

Figure 6B:
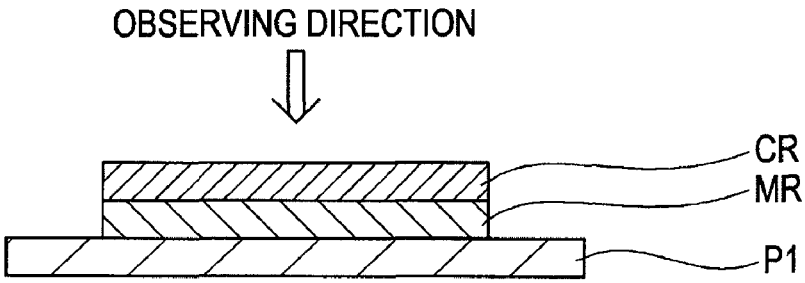

As shown in FIG. 6B, in the printed material, a metallic ink layer MR where dots are formed by using the metallic ink S is firstly positioned on the printing medium P1, and color ink layer CR where dots are formed by using the color inks is superposedly positioned on the metallic ink layer MR. When the printed material is observed in the direction from the color ink layer CR to the printing medium P1, the metallic color of the printed material can be observed.

In this manner, in the printing system 10 according to the invention, the nozzle column 256 for the light cyan ink Lc that is a specific color ink is disposed, the front end portion in the scan direction in which the ink ejecting is performed among the end portions in the alignment direction of the nozzle columns of the print head 250. Therefore, when the ink change from the light cyan ink Lc to the metallic ink S is performed, the metallic ink layer MR and the color ink layer CR are superposedly printed on the printing medium P1 in the order.

In addition, since the nozzle column that is diverted to the nozzle column ejecting the metallic ink S is the nozzle column corresponding to a specific color ink, color representation can be performed to some extent by using the three primary color inks without using the ink color corresponding to the diverting nozzle column. Particularly, in a case where the metallic color printing is performed by superposing the color ink layer CR and metallic ink layer MR, brightness of the image is generally decreased in comparison with a case where only the color ink layer CR is performed. However, according to the embodiment, if the ink change from the light ink where a concentration of coloring ingredient (in the embodiment, a dye compound) of the three primary color inks is lowered to the metallic ink S is performed, the deterioration in image quality that is caused from the decrease in the number of kinds of the color inks used for the printing can be suppressed. In addition, since the nozzle column 256 that originally corresponds to the light cyan ink Lc is diverted to the metallic ink S, the print head 250 needs not to have any nozzle column dedicated to the metallic ink S, so that it is possible to implement an economical printing system.

E. MODIFIED EXAMPLE

Modified examples of the aforementioned embodiment are described.

E-1. Modified Example 1

Figure 7A:
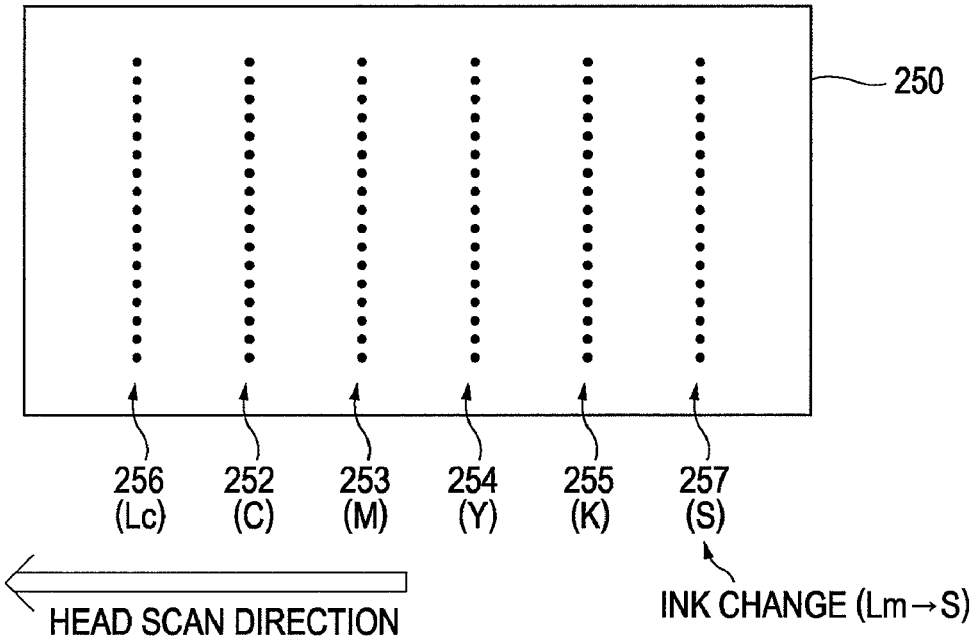
FIGS. 7A and 7B are views for explaining situation of ink change and printing according to a modified example.
Figure 7B:
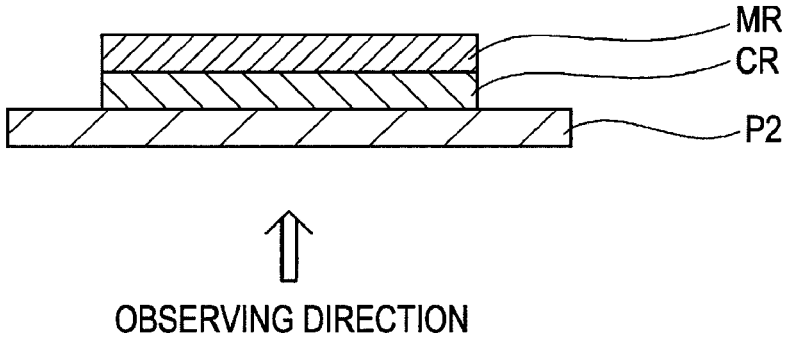

In the embodiment, a metallic ink layer MR and a color ink layer CR are formed on an opaque printing medium P1 in this order, and metallic color printing is performed. However, the order of forming the ink layers may be reversed. For example, as shown in FIG. 7B, in a case where printing is performed on a transparent printing medium P2, the color ink layer CR and the metallic ink layer MR may be formed on the printing medium P2 in this order. As a result, when a printed material is observed in the direction from printing medium P2 to the metallic ink layer MR, the metallic color of the printed material can be observed.

In this case, since the order of forming the metallic ink layer MR and the color ink layer CR may be reversed with respect to the order of the example, the metallic ink S may be designed to be ejected from the nozzle column that is disposed at the rear end portion in the scan direction in which the ink ejecting is performed among the end portions in the alignment direction of the nozzle columns of the print head 250. Therefore, as shown in FIG. 7A, if the ink change from the light magenta ink Lm that is a specific color ink corresponding to the nozzle column 257 disposed at the rear end in the scan direction to the metallic ink S is performed, the color ink layer CR and the metallic ink layer MR can be superposedly printed on the printing medium P1 in this order.

E-2. Modified Example 2

In the embodiment and Modified Example 1, the one-directional printing is exemplified as the metallic color printing. However, the printer 200 may be configured for bi-directional printing. More specifically, for example, the ink change from light inks corresponding to the nozzle columns 256 and 257 that are disposed at the two end portions in the alignment direction of the nozzle columns of the print head 250 to the metallic inks S may be performed.

Figure 8:
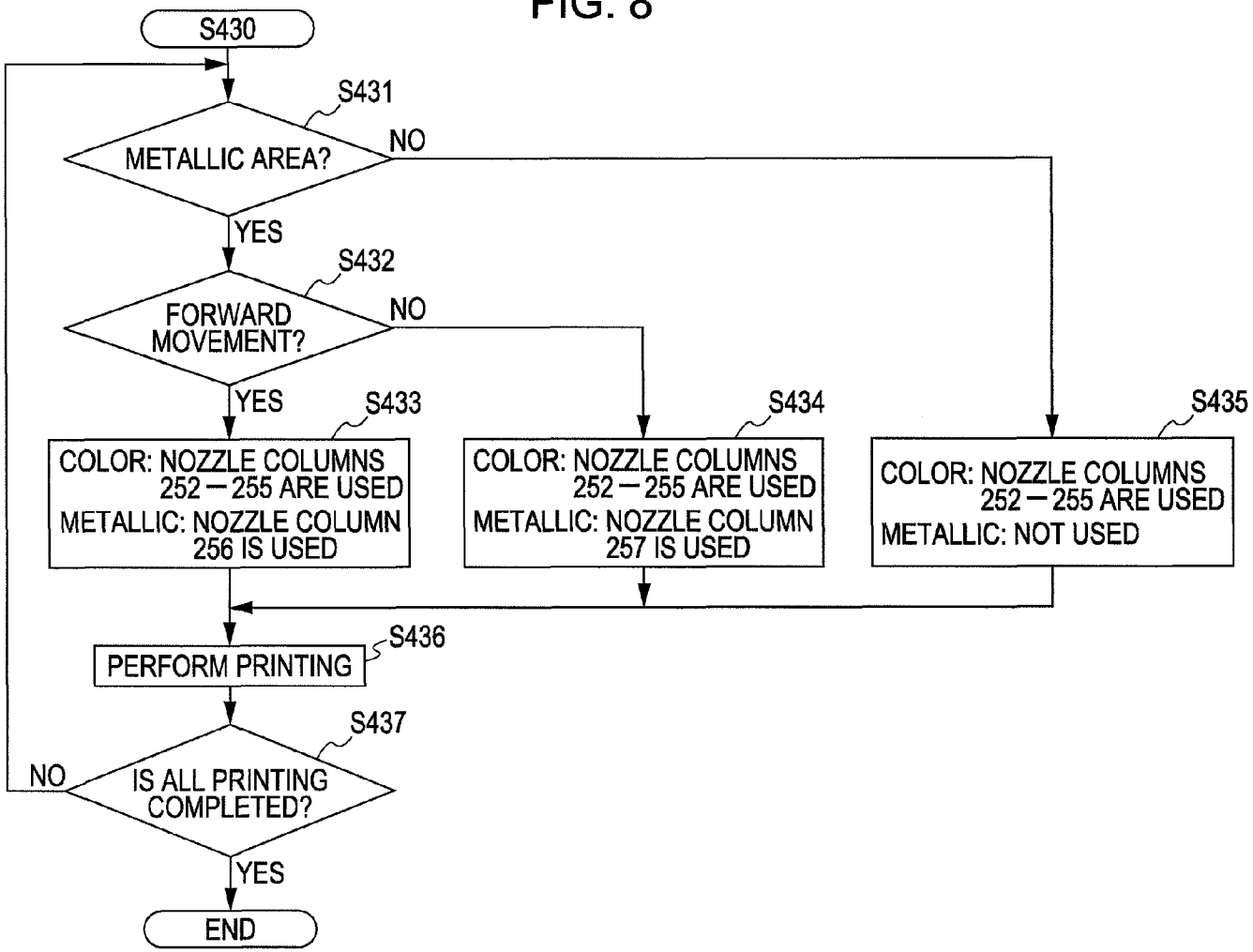
FIG. 8 is a flowchart showing details of a step S430 of a printing process according to another modified example.

In this case, since the bi-directional printing is performed, the Step 430 shown in FIG. 5 can be replaced with, for example, a process shown in FIG. 8. More specifically, after a halftone process, the computer 100 determines whether or not a raster of a to-be-printed object includes a metallic area (Step S431). As the result of determination, if the metallic area is not included (Step S431: NO), only the nozzle columns 252 to 255 ejecting the color inks among the nozzle columns 252 to 257 provided to the print head 250 are determined to be used, but the nozzle columns 256 and 257 ejecting the metallic inks S are determined not to be used (Step S435).

Figure 9A:
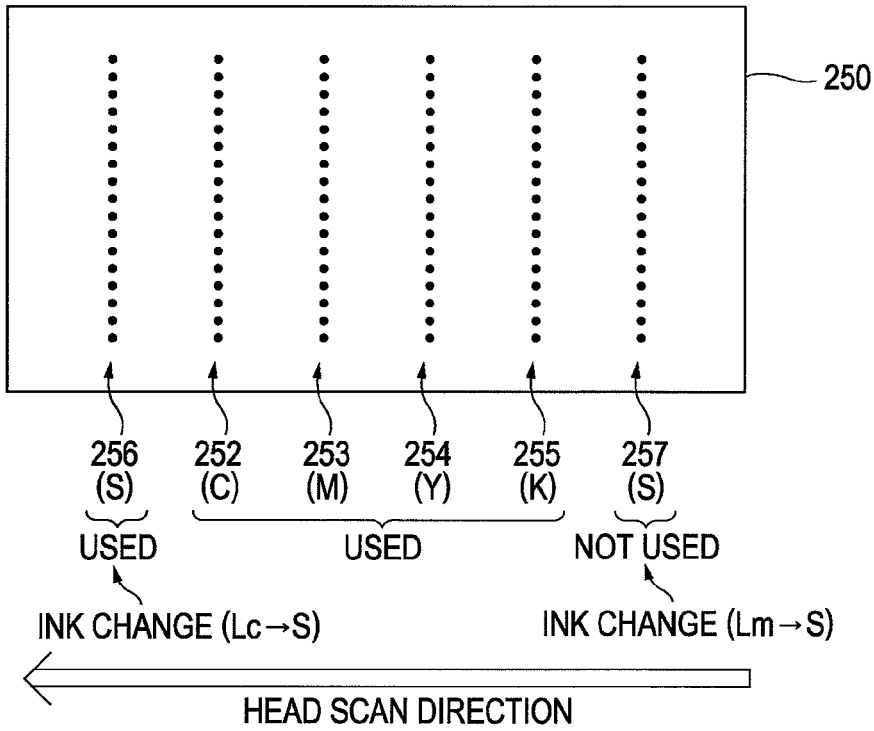
FIGS. 9A and 9B are views for explaining situation of ink change and bi-directional printing according to another modified example.

On the other hand, if the metallic area is included in the raster of the to-be-printed object (Step S431: YES), the computer 100 determines whether or not the currently-performed scan operation of the print head 250 is a movement in the forward movement path among the reciprocating movement in the main scan direction (Step S432). As the result of determination, if the currently-performed scan operation is the movement of the path of the forward movement (Step S432: YES), as shown in FIG. 9A, the computer 100 determines that the nozzle column 256 disposed at the front end portion in the scan direction of the print head 250 among the nozzle columns 252 to 255 ejecting the color inks and the nozzle columns 256 and 257 ejecting the metallic inks S is used (the nozzle column 257 disposed at the rear end portion in the scan direction is not used) (Step S433).

Figure 9B:
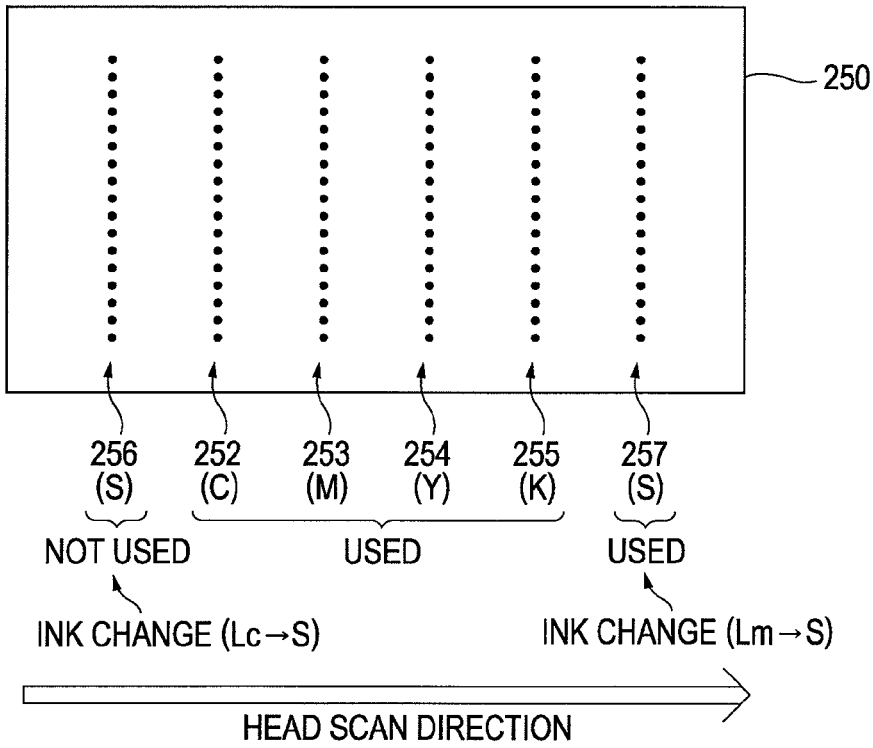

On the other hand, if the currently-performed scan operation of the print head 250 is not the movement in the forward movement path among the reciprocating movement in the main scan direction, that is, if the currently-performed scan operation is a movement in the backward movement path (Step S432: NO), as shown in FIG. 9B, the computer 100 determines that the nozzle column 257 disposed at the front end in the scan direction of the print head 250 among the nozzle columns 252 to 255 ejecting the color inks and the nozzle columns 256 and 257 ejecting the metallic inks S is used (the nozzle column 256 disposed at the rear end portion in the scan direction is not used) (Step S434).

If the to-be-used nozzle column is determined, the computer 100 controls the printer 200 to perform the printing by ejecting the metallic ink or the color ink from the to-be-used nozzle column determined in the Steps S433 to S435 during one-time scanning of the print head 250 (Step S436).

During the one-time scanning of the print head 250*b*, the computer 100 determines whether or not the printing for all the rasters is ended (Step S437). As the result of determination, if the printing is determined not to be ended (Step S437: NO), the computer 100 returns the process to the Step S431 to continue to perform the printing process on the raster where the printing is not performed. On the other hand, if the printing is determined to be ended (Step S437: YES), the computer 100 ends the printing process.

Even in a case where the printing is performed, the metallic color printing can be performed by forming the metallic ink layer MR and the color ink layer CR on the opaque printing medium P1 in this order. In addition, since the metallic ink S and the color ink are simultaneously ejected on the same raster by one-time main scan, the decrease in the printing speed can be suppressed. In addition, in a case where the metallic ink layer MR and the color ink layer CR are formed in the reverse order, the used and not-used nozzle columns among the nozzle columns 256 and 257 in each scan direction may be exchanged.

E-3. Modified Example 3

Figure 10:
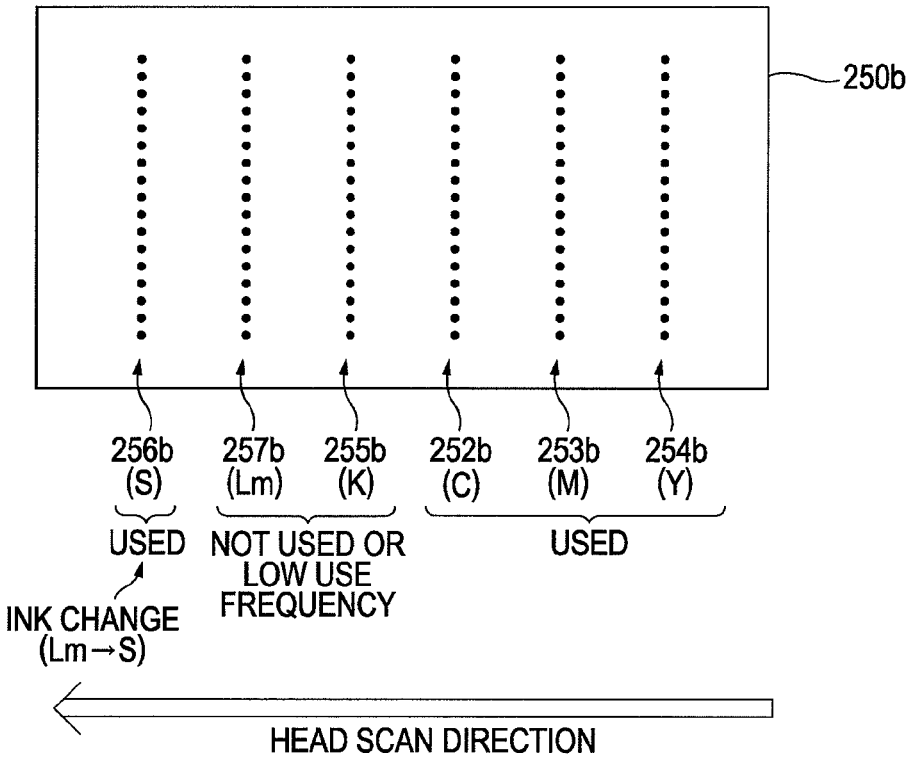
FIG. 10 is a view for explaining details of a print head 250*b* and situation of ink change according to another modified example.

FIG. 10 shows details of a print head 250*b* according to Modified Example 3. The print head 250*b* is different from the print head 250 shown in FIG. 6A in terms of the alignment of nozzle columns. More specifically, the example is different from the embodiment in that the nozzle column 257*b* and 255*b* corresponding to the specific color inks are disposed between the nozzle column 256*b* disposed at the front end portion in the scan direction of the print head and the nozzle columns 252*b* to 255*b* corresponding to the three primary colors.

In a case where the same metallic color printing as that of the embodiment is performed by using the print head 250*b*, if the to-be-printed image of the metallic area is to be formed with no use of the light magenta ink Lm and/or the black ink K or with almost no use thereof, and if the printing is performed by performing the conversion process in the Step S420, a time interval from the time when the metallic ink S is landed at a position on the printing medium to the time when the three primary color inks are landed at the same position can be secured as a time for drying the landed metallic ink S. Therefore, mixing of the metallic ink S and the three primary color inks can be suppressed, so that deterioration in image quality can be suppressed. If the nozzle column corresponding to the specific color ink is disposed between the nozzle columns where the ink change is performed and the nozzle columns corresponding to the primary colors, the above effect can be obtained irrespective of the alignment order of nozzle columns.

E-4. Modified Example 4

In the aforementioned embodiment and Modified Examples, the metallic color printing is performed through the ink change from the light cyan ink Lc and/or the light magenta ink Lm corresponding to the nozzle columns disposed at the end portions in the alignment direction of the nozzle columns of the print head 250 to the metallic ink S. However, the nozzle columns disposed at the end portions of the print head 250 are not limited to the nozzle columns corresponding to the light cyan ink Lc or the light magenta ink Lm, but the nozzle columns may correspond to the specific color inks other than the three primary color inks. For example, the nozzle column corresponding to the black ink K may be disposed at the end portion, and the ink change from the black ink K to the metallic ink S may be performed. Alternatively, in a case where the printer 200 has a configuration capable of using specific color inks such as a blue ink, a red ink, a green ink, an orange ink, and a clear ink, the nozzle column corresponding to the specific color inks may be disposed at the end portion of the print head 250, and the ink change from the specific color inks to the metallic ink S may be performed.

E-5. Modified Example 5

In the aforementioned embodiment and Modified Examples, a configuration where the metallic color printing is performed by superposedly forming a layer of metallic ink S and a layer of color ink on a printing medium is exemplified. However, the invention is not limited to a combination of the layer of metallic ink S and the layer of color ink, but the invention may be adapted to a configuration where an image layer representing an image and layers of various specific gloss agents are superposed. The specific gloss agent is an ink representing specific gloss on a printed surface of the printing medium. The specific gloss agent may be an ink of which optical property has a reflection angle dependency to express various hues according to a viewing angle when the ink is printed on a surface of the printing medium as well as a metallic ink including a pigment expressing a metallic sensation. More specifically, in addition to the metallic ink, a pearl glossy ink including a pigment expressing a pearl glossy sensation after the fixing on a surface of a printing medium or a lame ink or an earth ink including a pigment having micro-unevenness for expressing so-called lame sensation or earthy sensation that is caused from diffused reflection after the fixing on the surface of the printing medium may be used as the aforementioned ink.

In addition, the invention is not limited to the specific gloss agent, but it may be adapted to a case where an image layer and an auxiliary layer that assists the image layer are superposed. For example, a layer of assisting expression of the image layer can be used as the auxiliary layer. Herein, the phrase "assisting expression of the image layer" denotes expressing the color representation of the image layer, changing the color representation, and the like. For example, a white ink that is used as a base for expressing the color representation of the image layer and various inks that have a property of concealment may be used as an auxiliary material for forming the auxiliary layer.

In addition, for example, a layer of protecting or concealing the image layer may be used as the auxiliary layer. The auxiliary layer of protecting or concealing the image layer may be constructed with an overcoat agent for protecting the image layer by preventing the ink from peeling or deteriorating or an undercoat agent for improving a property of fixing of the image layer to the printing medium by forming a porous micro-particle layer. In addition, the auxiliary layer may be constructed with an ink having a low fixing force that is used to manufacture a scratch card.

In this manner, in a case where various layer and the image layer are superposedly printed, similarly to the aforementioned embodiment and Modified Examples, which one of the nozzle columns corresponding to the auxiliary layer which are disposed at the two end portions of the print head 250 is to be used may be determined by taking into consideration the order of forming the auxiliary layer and the image layer on the printing medium. In addition, the image layer is not limited to the plurality of the color inks like the embodiment. For example, a single color ink such as black ink K may be used.

E-6. Modified Example 6

In the aforementioned embodiment, the printing process shown in FIG. 5 is performed by the printing system 10 (a printing apparatus in a wide sense) including the computer 100 and the printer 200. However, a process equivalent to the printing process may be performed by a CPU in the control circuit 260 of the printer 200. Accordingly, the image data can be input from a digital camera, various memory cards, or the like, so that suitable printing can be performed by the printer 200 without using the computer 100.

E-7. Modified Example 7

In the aforementioned embodiment and Modified Examples, a configuration of a serial type ink jet printer where the print head performs printing by ejecting ink during the movement in the main scan direction is shown. However, the invention may be adapted to a line printer where a print head is non-movably fixed and the printing is performed in units of raster by nozzles aligned according to a width of a printing medium in a direction perpendicular to a transport direction of the printing medium.

Figure 11:
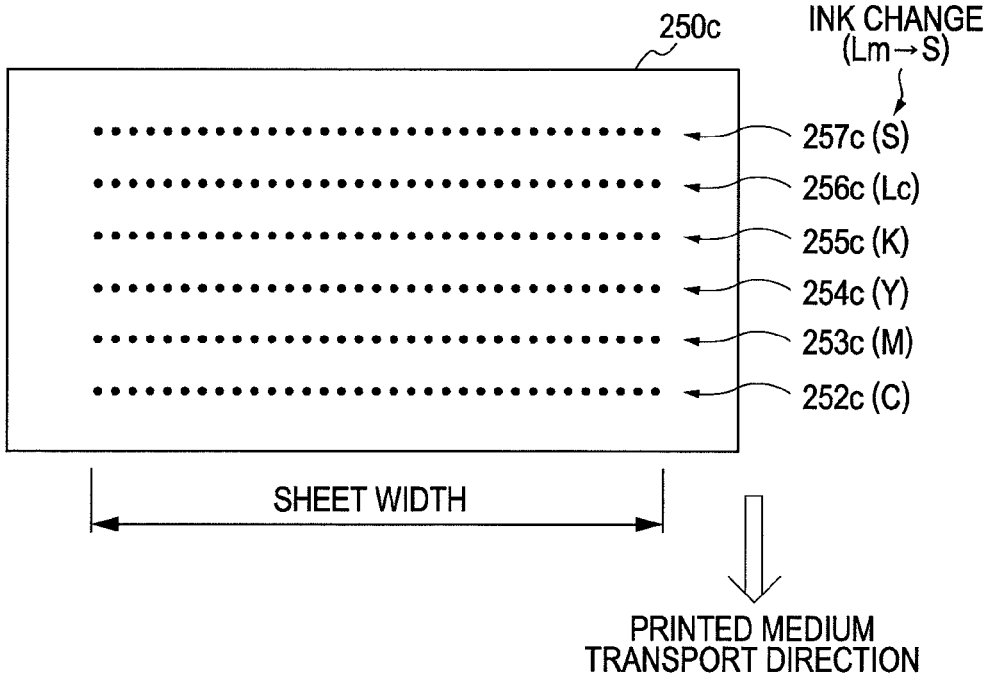
FIG. 11 is a view for explaining details of a print head 250*c* and situation of ink change according to another modified example.

More specifically, for example, as shown in FIG. 11, in the print head 250*c* of the line printer including nozzle columns corresponding to colors aligned according to the sheet width, the nozzle column 257*c* corresponding to a specific color ink (in the example, light magenta ink Lm) disposed at the rear end portion in the transport direction of the printing medium may be disposed at the end in the alignment direction of the nozzle columns, and the ink change from the light magenta ink Lm to a metallic ink S may be performed so that the printing can be performed. Accordingly, the metallic ink layer MR and the color ink layer CR may be superposedly printed on the printing medium in this order. In addition, in a case where the superposing order is reversed, the nozzle column corresponding to the specific color ink may be disposed at the front end portion of the print head 250*c* in the printing medium transport direction, and the ink change for the specific color ink may be performed. Next, the printing is performed.

Hereinbefore, while the exemplary embodiments of the invention are described, the invention is not limited thereto. Various modifications and changes can be made within the scope of the invention without departing from the spirit of the invention. For example, the invention can be implemented with a printing method, a printing program, or the like as well a configuration as a printing apparatus.

The disclosure of Japanese Patent Application No. 2008-219055 filed Aug. 28, 2008 including specification, drawings and claims is incorporated herein by reference in its entirety.

What is claimed is:

1. A printing apparatus that superposedly forms an image layer representing an image and a specific glossy layer that is different from the image layer on a printing medium, comprising:

a first connection unit that can be connected to a basic color ink container containing three primary color inks of which combination is used for performing color representation;

a second connection unit that can be connected to a specific color ink container containing a specific color ink other than the three primary color inks;

a reception unit that receives a kind of print available ink;

a print head where nozzle columns in which a plurality of nozzles are aligned in a predetermined direction are arrayed in a direction intersecting an alignment direction of the nozzles in the nozzle columns, and at least one of specific color nozzle columns ejecting the specific color ink among the nozzle columns is disposed as an end-portion specific color nozzle column to at least one of end portions of the print head in the array direction of the nozzle columns; and a printing unit that performs printing by moving the print head relative to the printing medium and ejecting the three primary color inks and/or the specific color ink on the printing medium from the nozzle columns, wherein at least the connection unit that can supply the ink to the end-portion specific color nozzle column inside the second connection unit can be connected to a specific gloss agent container containing a specific gloss agent that is used to form the specific glossy layer instead of the specific color ink container, and wherein, when the specific gloss agent container is connected to the second connection unit and the reception unit receives the specific gloss agent as the available ink, the printing unit ejects the specific gloss agent from the end-portion specific color nozzle column to form the specific glossy layer.

2. The printing apparatus according to claim 1, wherein the end-portion specific color nozzle columns are disposed at both end portions of the print head in the array direction of the nozzle columns, and wherein printing unit ejects the specific gloss agent from one of the end-portion specific color nozzle columns disposed at both end portions according to the direction of the relative movement of the print head to form the specific glossy layer.

3. The printing apparatus according to claim 1, wherein each of the basic color ink container, the specific color ink container, and the specific gloss agent container includes a storage unit storing the kind of the contained ink and a communication unit communicating with the printing apparatus, and wherein the reception unit performs the reception by receiving a signal indicating the kind of ink through the communication unit from the container that is connected to the first connection unit or the second connection unit.

4. The printing apparatus according to claim 1, wherein the end-portion specific color nozzle column is a nozzle column that ejects the specific color ink other than a black ink.

5. The printing apparatus according to claim 4, wherein the end-portion specific color nozzle column is a nozzle column that ejects a light ink where coloring ingredients of the three primary color inks have low concentrations.

6. The printing apparatus according to claim 1, wherein the specific gloss agent is an ink of which optical property has a reflection angle dependency when the ink is printed on a surface of the printing medium.

7. The printing apparatus according to claim 1, wherein the specific gloss agent is an ink that includes a pigment expressing a metallic sensation.

* * * * *